United States Patent [19]

Grassl

[11] Patent Number: 4,809,213

[45] Date of Patent: Feb. 28, 1989

[54] TWO-TRACK CONVOLVER OPERATING WITH ACOUSTIC WAVES AND WITH SUPPRESSION OF SELF-CONVOLUTION SIGNALS

[75] Inventor: Hans-Peter Grassl, Zorneding, Fed. Rep. of Germany

[73] Assignee: Siemens Aktiengesellschaft, Berlin and Munich, Fed. Rep. of Germany

[21] Appl. No.: 898,373

[22] Filed: Aug. 20, 1986

[30] Foreign Application Priority Data

Aug. 21, 1985 [DE] Fed. Rep. of Germany ..... 3529901

[51] Int. Cl.[4] ..... G06G 7/19

[52] U.S. Cl. ..... 364/821; 364/819

[58] Field of Search ..... 364/605, 821, 602, 819, 364/841; 310/313 R, 313 C

[56] References Cited

U.S. PATENT DOCUMENTS

| | | | |
|---|---|---|---|
| 3,770,949 | 11/1973 | Whitehouse et al. | 235/181 |
| 4,114,116 | 9/1978 | Reeder | 333/196 X |
| 4,181,904 | 1/1980 | Weller | 364/821 X |
| 4,464,597 | 8/1984 | Setsune | 310/313 |
| 4,556,949 | 12/1985 | Solie | 364/821 |
| 4,592,009 | 5/1986 | Masheff | 364/821 |
| 4,649,509 | 3/1987 | Engan | 364/821 |
| 4,701,657 | 10/1987 | Grassl | 333/196 X |

OTHER PUBLICATIONS

E. Stern et al., "New Adoptive Signal Processing Concept" Electronics Letters, Mar. 7, 1974, pp. 58–59.

M. Luukkala et al., "Convolution and Time Inversion Using Parametric Interactions of Acoustic Surface Waves", Applied Physics Letters, vol. 18, No. 9, May 1, 1971, pp. 393–394.

IEEE–1982 Ultrasonics Symposium–Swanson et al., "Surface Acoustic Wave Convolver Using Counter-propagating Symmetric and Antisymmetric Waveguide Modes", pp. 130–133.

IEEE–1982 Ultrasonics Symposium–Morgan et al., "Spatial Uniformity of S A W Convolvers", pp. 143–148.

Detranould et al., "Acoustic Convolver Using Multistrip Beamwidth Compressors" 1974 Ultrasonics Symposium Proceedings, IEEE Cat. #74 CHO 896–ISU, pp. 224–227.

Yao "High Performance Elastic Convolver with Extended Time–Bandwidth Product", 1981 IEEE Ultrasonics Symposium, pp. 181–185.

IEEE Group on Sonics & Ultrasonics, Oct. 27–29, 1982, San Diego, CA–1982 Ultrasonics Symposium Proceedings, B. R. McAvoy, editor, pp. 113–118.

*Primary Examiner*—Jerry Smith

*Assistant Examiner*—Charles B. Meyer

[57] ABSTRACT

A two-track convolver has input transducer assemblies at each end of integrated electrodes. Each of the input transducer assemblies is formed of two individual transducers which are connected in series. One of the transducer input assemblies connects to an input signal and the other of the input assemblies connects to a reference signal. Transducers which are diagonally arranged with respect to the two integration electrodes connect to reference potential. For a given input impedance, the system permits a greatest possible chirp duration corresponding to a large length of the individual transducers.

8 Claims, 1 Drawing Sheet

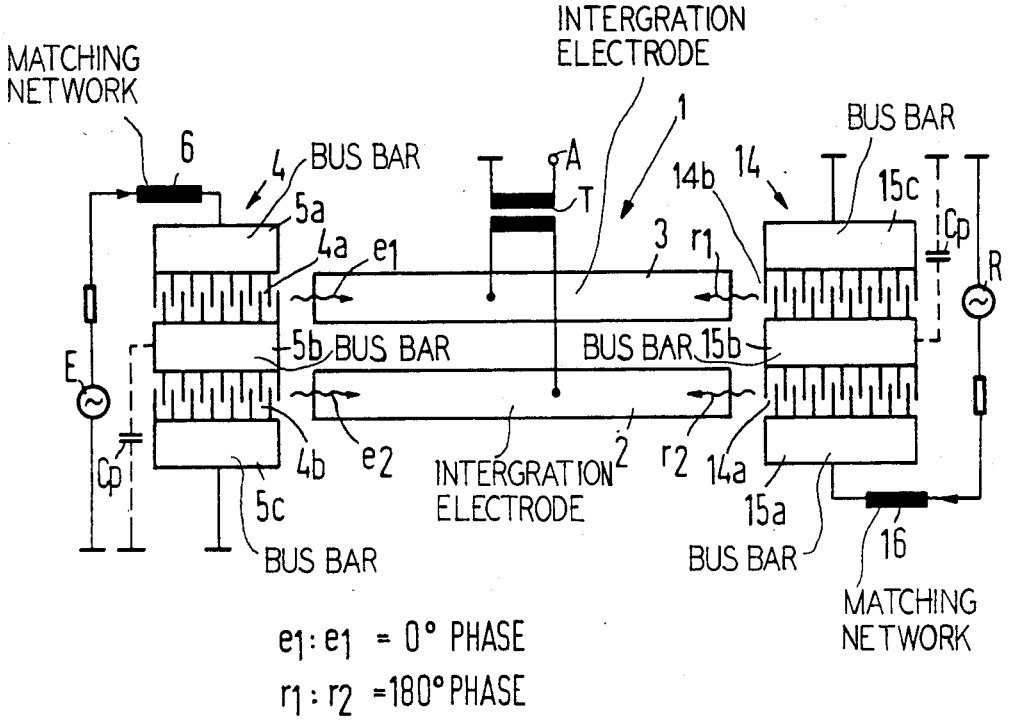
$e_1 : e_1$ = 0° PHASE
$r_1 : r_2$ = 180° PHASE

TWO-TRACK CONVOLVER OPERATING WITH ACOUSTIC WAVES AND WITH SUPPRESSION OF SELF-CONVOLUTION SIGNALS

RELATED APPLICATION

The following application is related to the present application: "CONVOLVER ARRANGEMENT WITH ACOUSTIC WAVES", Hans Peter Grassl, inventor, Ser. No. 898,375.

BACKGROUND OF THE INVENTION

The present invention relates to a two-track convolver. A two-track convolver having suppression of self-convolution signals is known from Proc. IEEE, Ultrasonics Symposium (1974), pages 224–227 and (1981), pages 181–185.

The acoustic waves employed in conjunction with convolvers and similar electrical arrangements involve acoustic waves which proceed in a substrate close to the surface or in the surface. Such acoustic waves are known as Rayleigh waves, Bleustein waves, Love waves, SSBW waves, SABS waves, and the like which shall be referred to below in general as surface waves (even though only the first two wave types are essentially understood as surface waves in the narrowest sense).

A surface wave convolver is an electrical means for extremely high frequencies, particularly beginning in the MHz region. Such a convolver is employed for the processing of, for example, binary orthogonal keying (BOK) signals. A convolver is a compilation of a plurality of structures arranged on the surface of a substrate, and composed, for example, of lithium niobate. Structures for the two-track construction of the convolver employed for self-convolution suppression include two strip-shaped integration electrodes, two respective beam compressor structures added thereto under given conditions, and two respective, i.e. a total of four input transducers. Two input transducers are intended for the input signals E, and two input transducers are intended for the reference signal (R). The output terminals of the two integration electrodes are electrically connected to one another via a repeater or transformer. The repeater or transformer is the actual output of the two-track convolver. The processed input signals corresponding to the function of the convolver can be obtained at this output without having the self-convolution signals appearing as well.

The self-convolution signal is based on an acoustic wave generated in the input transducer for the reference signals by the acoustic wave sent into the convolver from the input transducer of the input signal. This acoustic wave runs in the opposite direction in the region of the integration electrode and generates self-convolution signals (which are undesired) together with the wave still being supplied by the input signal of the input transducer.

The suppression of the self-convolution is possible since, as is known, these respectively returning waves are antiphase relative to one another in the two integration electrodes.

As is the case for all electrical arrangements of high-frequency technology, care must be exercised regarding the proper matching of the individual, existing networks. For a two-track convolver as well, a respective matching network is required for the side of the input signal and for the side of the reference signal in order to have matching of the respective input impedance. The simplest possible matching network is an inductance whose value of inductance is matched to the capacitance of the respective input transducer. In comparison to one-track convolvers, however, two respective input transducers are connected in parallel in a two-track convolver. This is advantageous in order to guarantee high electrical symmetry of the two respectively coupled input transducers. As a result of the parallel connection, however, an impedance that is equal to half the impedance of every individual input transducer is obtained at the terminals of these transducers.

SUMMARY OF THE INVENTION

An object of the present invention is to specify an optimally easily realizable technique which allows a transducer design intended for a standard one-track convolver to be also employed for a two-track convolver.

This object is achieved by providing for each of the input transducer assemblies at the opposite ends of the convolver integrated electrodes two individual transducers which are series connected with one another. One of the two individual transducers at each transducer assembly is connected to a reference potential such that transducers which are arranged diagonally relative to one another and with respect to the two integration electrodes are connected to the reference potential.

The invention is based on the idea of achieving the 100 ohm impedance required for a standard 50 ohm system given a two-track convolver comprising input transducers connected in parallel for each and every one of these transducers by means of an auxiliary technique, without having to accept disadvantages. In and of itself, twice as high an impedance (capacitive impedance as well) could be achieved without further ado in that the respective input transducer is reduced to about half its length, or is reduced to about half the number of electrode fingers. This, however, would lead to what is referred to as a chirp duration which would be undesirably short, and has a disadvantageous influence on aperture and band width. The invention, however, has departed from the standard parallel connection of the input transducers and has instead provided a series connection of the respective two input transducers. In, for example, a 50 ohm system, this leads to the fact that each of the individual input transducers now has only 25 ohms input impedance. In comparison to the one-track transducer, an even more favorable, longer chirp duration can thus be provided.

This idea alone is not adequate, however, in order to avoid anticipated disadvantages. Given two-track convolvers, the series connection of the two input transducers in each of the input transducer assemblies for the input signal and for the reference signal results in incomplete compensation of the self-convolution due to parasitic capacitances.

In a further technique of the invention, the series-connected, two input transducers with a common bus bar are arranged on the surface of a substrate. Thus, with reference to the two integration electrodes, each end which lies diametrically opposite is connected to ground. An opposite a-symmetry of the two input sides (for input signals on the one hand and a reference signal on the other hand) of the two-track convolver thus exists. This compensates the anticipated lack of equilibrium and guarantees the required compensation of the self-convolution effect.

BRIEF DESCRIPTION OF THE DRAWING

The drawing FIGURE illustrates the improved two-track convolver according to the invention wherein series connected transducers are provided in association with the input signal and the reference signal.

DESCRIPTION OF THE PREFERRED EMBODIMENTS

A two-track convolver 1 is illustrated in the drawing FIGURE, structures thereof being arranged on a surface of a substrate to be employed for this purpose. The integration electrodes are referenced 2 and 3. Reference letter E references the input signal. A first input transducer assembly 4 corresponding to the input signal E is formed of the two series-connected individual first and second input transducers 4*a* and 4*b*. The first input transducer 4*a* is associated with the integration electrode 3 and the second input transducer 4*b* is associated with the integration electrode 2. 5*a*, 5*b*, and 5*c* reference the three bus bars of the series-connected, individual input transducers 4*a* and 4*b*. The inductance representing the corresponding matching network 6 is connected to the bus bar 5*a*. The bus bar 5*c*, by contrast, is at ground or reference potential. The parasitic capacitance of the bus bar 5*b* which floats is indicated with Cp. This unavoidable, parasitic capacitance $C_p$, which cannot be completely technologically controlled, leads to the fact that it cannot be guaranteed that a signal voltage of exactly the same size is at the two input transducers 4*a* and 4*b*. A higher signal voltage at one transducer 4*a* or 4*b* leads to a correspondingly greater amplitude of the acoustic wave supplied into the integration electrode 2 or 3.

The series connection of individual first and second input transducers 14*a* and 14*b* for the reference signal R provided in accordance with the invention forms a second input transducer assembly 14. The matching network for the feed of the reference signal R into the second transducer assembly 14 is referenced 16. The three bus bars of the second transducer assembly 14 are referenced 15*a*, 15*b*, and 15*c*. Here, too, a parasitic capacitance Cp again exists, this being indicated in the drawing FIGURE. As has been identified, these two capacitances are essentially of about the same size.

An output A is provided via a transformer T connected to the two integration electrodes 2 and 3.

The design for each of the individual transducers 4*a*, 4*b* on the one hand and 14*a*, 14*b* on the other hand is preferably identical. In accordance with the series connection shown, a length of the corresponding individual transducers 4*a* through 14*b* in the invention can even be made more than twice as great as would be the case for a one-track convolver (which would be formed of only one input transducer 4*a*, of the integration electrode 3, and of a single, second input transducer 14*b*. A 50 ohm system is assumed, for example, in both instances.

As may be seen from the drawing FIGURE, in a further technique of the invention, relative to the integration electrodes, the bus bar 5*c* connected to the reference potential of the first input transducer assembly for the input signal E is positioned diametrically opposite the bus bar 15*c* of the second input transducer assembly 14, which likewise is at ground or reference potential. When, for example, the individual transducer 4*a*, and thus the individual transducer 14*a* as well, is to be charged with a higher signal voltage (of the input signal or of the reference signal and with respect to the individual transducer assemblies 4*b* or 14*b*), then the acoustic wave of the input signal E would in fact be greater in the integration electrode 3 than in the integration electrode 2. This greater input signal wave in the integration wave electrode 3, however, would experience lower re-emission in the individual transducer assembly 14*b* (due to the parallel capacitance Cp). On the average, the product of the forward wave and of the re-emitted wave, i.e. the self-convolution signal, in the invention is exactly as great for the integration electrode 3 as it is for the integration electrode 2. In the electrode 2, a comparatively smaller wave of the input signal E and comparatively higher re-emission wave from the individual transducer assembly 14*b* then occurs. This again produces the same product of the forward and the re-emitted wave.

Thus with the techniques of the invention, full compensation of the self-convolution signal is achieved for this two-track convolver. Also, this compensation is realized with individual input transducers 4*a* through 14*b* of given input impedance values which are of comparatively lower resistance in comparison to the prior art.

Although various minor changes and modifications might be proposed by those skilled in the art, it will be understood that I wish to include within the claims of the patent warranted hereon all such changes and modifications as reasonably come within my contribution to the art.

I claim as my invention:

1. A two-track convolver operating with acoustic waves, comprising:

two integration electrodes arranged on a substrate and parallel to one another;

a first input transducer assembly connected to an input signal E and being positioned at one end of the integration electrodes and a second input transducer assembly connected to a reference signal R and arranged adjacent an end of the integration electrodes opposite to the input signal end thereof;

each of the first and second input transducer assemblies comprising first and second individual transducers connected in series with one another, the individual transducers of the respective transducer assemblies being of a same design; and one of the transducers of each of the transducer assemblies being connected to a reference potential, add these two transducers connected to the reference potential being diagonally arranged with respect to the two integration electrodes.

2. A two-track convolver according to claim 1 wherein the first and second individual transducers of each of the transducer assemblies are serially integrated transducers with a common bus bar.

3. A convolver according to claim 1 wherein the input signal E has a first give input impedance associated therewith, the reference signal R has a second given input impedance associated therewith, the first and second transducers of the first input transducer assembly each having an input impedance lower than said first given input impedance, and said first and second transducers of said second input transducer assembly each having an input impedance lower than said second given input impedance.

4. A convolver according to claim 3 wherein the first and second given input impedances are equal and the input impedances of the individual transducers of both the first and second input transducer assembly are one half the first and second given input impedances.

5. A two-track convolver operating with acoustic waves, comprising:

first and second integrated electrodes arranged on the substrate;

at one end of the integration electrodes an input signal being provided connecting through an impedance matching network to first and second series connected transducers, the first transducer being arranged in line with the first electrode and the second transducer being arranged in line with the second electrode, and wherein three bus bars are provided with a central bus bar being common to the two transducers, the bus bar of the first transducer adjacent the central bus bar connecting to the impedance matching network and the bus bar of the second transducer adjacent the central bus bar connecting to a reference potential;

at the other end of the integrated electrodes a reference signal input being provided connecting to an impedance matching network to a second transducer assembly, said second transducer assembly including first and second transducers arranged in series such that the first transducer is in line with the first electrode and the second transducer is in line with the second electrode, and wherein three bus bars are provided, with a central bus bar being common to the two transducers, the first transducer bus bar adjacent the common bus bar being connected to reference potential and the second transducer bus bar adjacent the common bus bar being connected to the reference signal; and means connecting to the integrated electrodes for providing an output from the convolver 6. A two-track convolver according to claim 5 wherein the central common bus bars are floating.

7. A two-track convolver operating with acoustic waves, comprising:

two integration electrodes arranged on a substrate and parallel to one another;

a first input transducer assembly connected to an input signal source of given impedance at one end of both of the integration electrodes and a second input transducer assembly connected to a reference signal source and of said given impedance and arranged adjacent an end of both of the integration electrodes opposite to the input signal end thereof;

each of the first and second input transducer assemblies comprising first and second individual transducers connected in series with one another, the individual transducers of the respective transducer assemblies being of a same design and having an input impedance lower than said given impedance; and one of the transducers of each of the transducer assemblies being connected to a reference potential, and these two transducers connected to the reference potential being diagonally arranged with respect to the two integration electrodes.

8. A convolver according to claim 7 wherein the input impedance of the transducers is one half the given impedance.

* * * * *